US009394800B2

(12) United States Patent
Zheng et al.

(10) Patent No.: US 9,394,800 B2
(45) Date of Patent: Jul. 19, 2016

(54) TURBOMACHINE HAVING SWIRL-INHIBITING SEAL

(71) Applicant: General Electric Company, Schenectady, NY (US)

(72) Inventors: Xiaoqing Zheng, Niskayuna, NY (US); Jason Winfred Jewett, Clifton Park, NY (US); Richard James Miller, Jr., Round Lake, NY (US)

(73) Assignee: General Electric Company, Schenectady, NY (US)

( * ) Notice: Subject to any disclaimer, the term of this patent is extended or adjusted under 35 U.S.C. 154(b) by 732 days.

(21) Appl. No.: 13/745,890

(22) Filed: Jan. 21, 2013

(65) Prior Publication Data

US 2014/0205444 A1 Jul. 24, 2014

(51) Int. Cl.

| | |
|---|---|
| ***F01D 11/02*** | (2006.01) |
| ***F01D 11/04*** | (2006.01) |
| ***F01D 11/00*** | (2006.01) |
| *F01D 11/08* | (2006.01) |

(52) U.S. Cl.

CPC ..... *F01D 11/04* (2013.01); *F01D 11/001* (2013.01); *F01D 11/08* (2013.01); *F05D 2240/11* (2013.01); *F05D 2240/80* (2013.01)

(58) Field of Classification Search

CPC ..... F01D 11/00; F01D 11/001; F01D 11/005; F01D 11/006; F01D 11/02; F01D 11/04; F01D 11/08; F01D 11/10; F01D 11/12; F01D 11/122; F05D 2240/11; F05D 2240/80; F05D 2240/81

USPC ..... 415/173.1, 173.5, 173.6, 173.7

See application file for complete search history.

(56) References Cited

U.S. PATENT DOCUMENTS

| | | | | | |
|---|---|---|---|---|---|
| 2,291,828 | A * | 8/1942 | New | F01D 5/145 | 415/115 |
| 3,746,462 | A * | 7/1973 | Fukuda | F01D 11/10 | 415/115 |
| 4,057,362 | A * | 11/1977 | Schwaebel | F01D 11/02 | 277/419 |
| 4,662,820 | A * | 5/1987 | Sasada | F04D 29/161 | 415/173.6 |
| 5,161,943 | A * | 11/1992 | Maier | F01D 11/02 | 277/412 |
| 5,190,440 | A * | 3/1993 | Maier | F01D 11/02 | 277/412 |
| 5,222,742 | A * | 6/1993 | Roberts | F16J 15/4476 | 277/420 |
| 5,224,713 | A * | 7/1993 | Pope | F01D 11/02 | 277/415 |
| 5,547,340 | A * | 8/1996 | Dalton | F01D 11/001 | 277/412 |
| 5,775,873 | A * | 7/1998 | Dalton | F01D 11/001 | 415/121.2 |
| 6,761,529 | B2 * | 7/2004 | Soechting | F01D 5/187 | 415/115 |

(Continued)

FOREIGN PATENT DOCUMENTS

| | | | | |
|---|---|---|---|---|
| GB | 1484289 | A * | 9/1977 | F01D 25/32 |

*Primary Examiner* — Igor Kershteyn
*Assistant Examiner* — Christopher R Legendre
(74) *Attorney, Agent, or Firm* — Ernest G. Cusick; Hoffman Warnick LLC

(57) ABSTRACT

Various embodiments include a turbomachine including a swirl-inhibiting seal. In various particular embodiments, a turbomachine includes: a rotor section having sets of axially disposed blades; a diaphragm section at least partially surrounding the rotor section, the diaphragm section including a set of nozzles positioned between adjacent sets of axially disposed blades, wherein the set of nozzles includes at least one nozzle having: a base section coupled to the diaphragm section; a blade coupled to the base section; and a radial tip section coupled to a radial end of the blade, the radial tip section including an axially extending flange having a slot extending therethrough for controlling fluid flow within the turbomachine.

6 Claims, 6 Drawing Sheets

(56) References Cited

U.S. PATENT DOCUMENTS 6,860,718 B2 * 3/2005 Suzuki ..... F01D 5/225 415/173.5
7,032,903 B1 * 4/2006 Dalton ..... F01D 11/001 277/355
7,296,964 B2 * 11/2007 Montgomery ..... F01D 11/001 415/108
7,967,559 B2 * 6/2011 Bunker ..... F01D 5/081 415/170.1
8,939,711 B2 * 1/2015 Lee ..... F01D 11/001 415/116
2005/0067789 A1 3/2005 McHale et al.
2008/0056895 A1 * 3/2008 Senoo ..... F01D 5/143 415/199.4
2013/0004290 A1 * 1/2013 Krishnan ..... F01D 11/127 415/1
2014/0037431 A1 * 2/2014 Okuno ..... F01D 25/007 415/121.2
2014/0205444 A1 * 7/2014 Zheng ..... F01D 11/001 415/173.1

* cited by examiner

TURBOMACHINE HAVING SWIRL-INHIBITING SEAL

FIELD OF THE INVENTION

The subject matter disclosed herein relates to power systems. More particularly, the subject matter relates to turbine turbomachine systems.

BACKGROUND OF THE INVENTION

Conventional turbomachines (also referred to as turbines), such as steam turbines, generally include a casing enclosing a rotating shaft (also referred to as a rotor) and a plurality of radially extending rows of blades affixed to the shaft. Pressurized steam directed onto the blades causes blade and shaft rotation. The serial steam path typically includes a steam inlet, a plurality of steam pressure zones within the turbine and a steam outlet.

Conventionally, the steam turbomachine (turbine) is segregated into a plurality of pressure zones between successive stages of stationary and rotating blade rows. The turbine blade geometries and configurations are intended to maximize the efficiency of deriving energy from the steam flow, thus increasing the overall efficiency of an electrical generating plant which utilizes the steam turbomachine (e.g., to drive an electric generator).

Regions where the steam turbine shaft penetrates the turbine casing are sealed to prevent the escape of pressurized steam from the casing. Further, in order to improve turbine efficiency, conventional turbine designs have utilized interstage seals to prevent steam from bypassing stage stationary blades or by-passing rotating blades through the gap between stationary and rotating components.

Steam swirls, caused by rotating components or blades, once getting into cavities between seal teeth, can generate unsteady aerodynamic forces. Such forces acting on rotor surface can lead to rotor instability. As more and tighter seals are used to improve turbomachine efficiency, swirl-induced rotor-dynamic instability becomes more and more significant, especially for large steam turbines. To improve rotor-dynamic stability, anti-swirl teeth or swirl breaks have been used to kill swirl or reverse swirl direction. Conventional anti-swirl or swirl break devices have to be positioned at a tight clearance with rotor surface to render them effective. However, those devices are not rub-friendly. To avoid hard rubbing (e.g., contact between stationary and rotating components), the conventional anti-swirl devices are attached to a packing ring which is flexibly attached to stationary component with a spring element that biases the ring to close. Such an approach requires considerable space in turbomachine. Advances in turbomachine technology have also reduced the spacing between components in the turbomachines, making it more difficult to implement traditional anti-swirl rings in the fluid flow path. As such, current approaches for addressing fluid swirl in turbomachines are lacking in one or more respects.

BRIEF DESCRIPTION OF THE INVENTION

Various embodiments include a turbomachine including a swirl-inhibiting packing. In various particular embodiments, a turbomachine includes: a rotor section having sets of axially disposed blades; a diaphragm section at least partially surrounding the rotor section, the diaphragm section including a set of nozzles positioned between adjacent sets of axially disposed blades, wherein the set of nozzles includes at least one nozzle having: a base section coupled to the diaphragm section; a blade coupled to the base section; and a radial tip section coupled to a radial end of the blade, the radial tip section including an axially extending flange having a slot extending therethrough for controlling fluid flow within the turbomachine.

A first aspect of the invention includes a turbomachine having: a rotor section having sets of axially disposed blades; a diaphragm section at least partially surrounding the rotor section, the diaphragm section including a set of nozzles positioned between adjacent sets of axially disposed blades, wherein the set of nozzles includes at least one nozzle having: a base section coupled to the diaphragm section; a blade coupled to the base section; and a radial tip section coupled to a radial end of the blade, the radial tip section including an axially extending flange having a slot extending therethrough for controlling fluid flow within the turbomachine.

A second aspect of the invention includes a turbomachine having: a rotor section having sets of axially disposed blades; a diaphragm section at least partially surrounding the rotor section, the diaphragm section including a set of nozzles positioned between adjacent sets of axially disposed blades, wherein the set of nozzles includes at least one nozzle having: a base section coupled to the diaphragm section; a blade coupled to the base section; and a radial tip section coupled to a radial end of the blade, the radial tip section including: a radially facing surface; an axially facing surface adjacent the radially facing surface; and a slot extending through the axially facing surface and the radially facing surface for controlling fluid flow within the turbomachine.

A third aspect of the invention includes a turbomachine having: a rotor section having sets of axially disposed blades, each of the axially disposed blades including: a base section coupled to a body of the rotor; and a blade section extending radially from the base section; a diaphragm section at least partially surrounding the rotor section, the diaphragm section including a set of nozzles positioned between adjacent sets of the axially disposed blades, wherein the set of nozzles includes at least one nozzle having: a base section coupled to the diaphragm section; a blade coupled to the base section; and a radial tip section coupled to a radial end of the blade; a set of radially extending seal teeth extending from one of the body of the rotor or the radial tip section of the at least one nozzle; and a radial step extending radially from the diaphragm section, the radial step having a slot extending therethrough for controlling fluid flow within the turbomachine.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
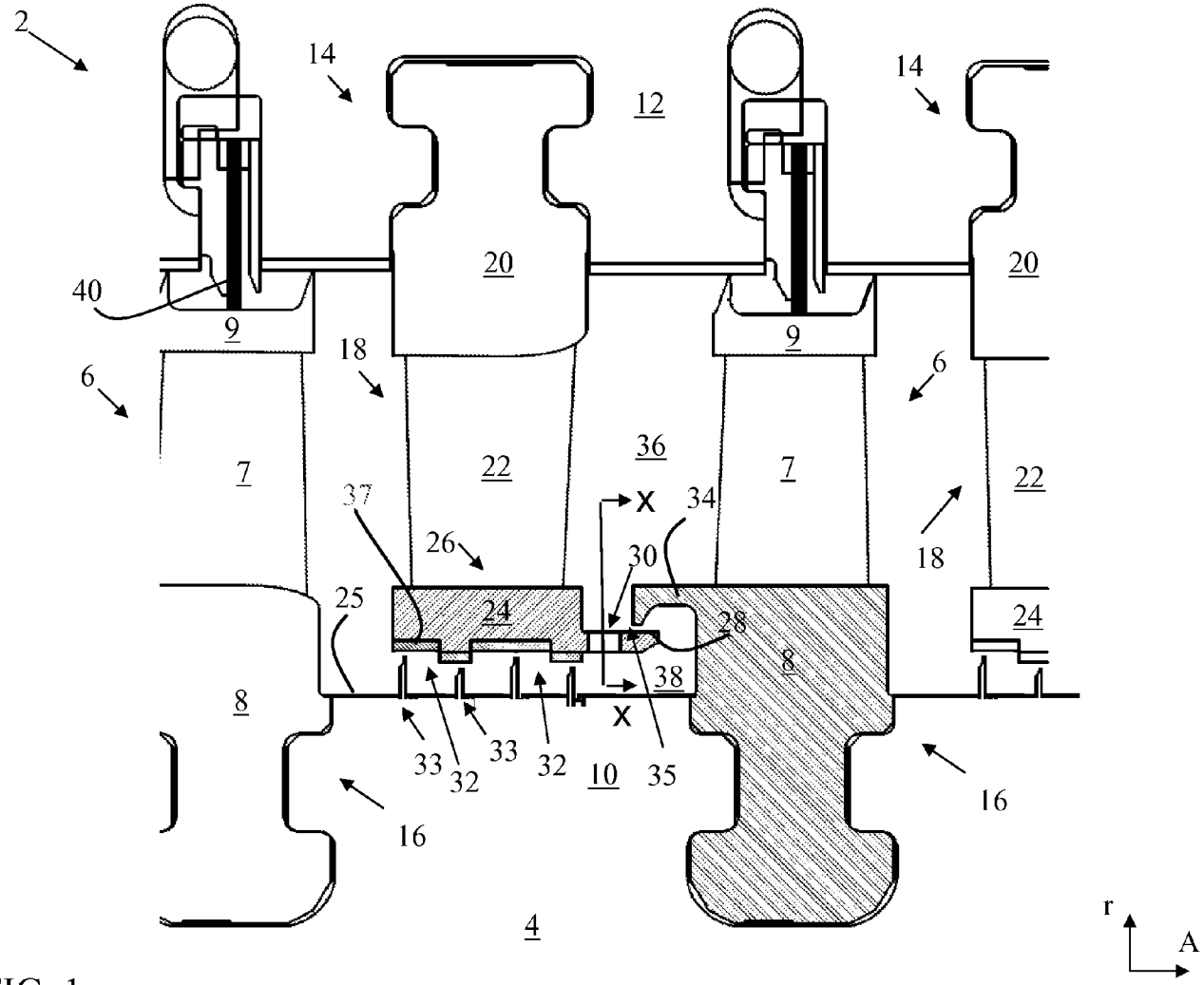
FIG. 1 shows a schematic cross-sectional view of a turbomachine with a swirl-inhibiting design according to various embodiments of the invention.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As noted, the subject matter disclosed herein relates to power systems. More particularly, the subject matter relates to turbine turbomachine systems.

As described herein, in conventional turbomachines, regions where the steam turbine shaft penetrates the turbine casing are sealed to prevent the escape of pressurized steam from the casing. Further, in order to improve turbine efficiency, conventional turbine designs have utilized inter-stage seals to prevent steam from bypassing stage stationary blade or by-passing rotating blade through the gap between stationary and rotating components.

However, these conventional systems, including their seal designs, are vulnerable to swirls in the fluid (steam) flow that enter seal cavities, which can lead to rotor-dynamic instability. Swirls, caused by rotating components or blades, once getting into cavities between seal teeth, can generate unsteady aerodynamic forces. Such forces acting on the rotor's surface can lead to rotor instability. As more and tighter seals are used to improve turbomachine efficiency in advancement of the technology, swirl-induced rotor-dynamic instability becomes more and more significant, especially for large steam turbines. To improve rotor-dynamic stability, anti-swirl teeth or swirl breaks have been used to kill swirl or reverse swirl direction. Conventional anti-swirl or swirl break devices are positioned at a tight clearance with the rotor surface to render them effective. However, those devices are not rub-friendly. To avoid hard rubbing (e.g., contact between stationary and rotating components), these anti-swirl devices are attached to a packing ring that is flexibly attached to a stationary component with a spring element that biases the ring to close. Such an approach requires considerable space in the turbomachine. Advances in turbomachine technology have also reduced spacing between components in the turbomachines, making it more difficult to implement traditional anti-swirl rings in the fluid flow path. As such, current approaches for addressing fluid swirl in turbomachines are lacking in one or more respects.

In contrast to the conventional approaches, aspects of the invention include a turbomachine axial nozzle seal including a swirl-reducing slot. In some cases, the swirl-reducing slot extends at least partially radially through the axial nozzle seal. In various embodiments, the swirl-reducing slot extends partially radially and partially axially through the seal portion.

Various aspects of the invention include a turbomachine having: a rotor section having sets of axially disposed blades; a diaphragm section at least partially surrounding the rotor section, the diaphragm section including a set of nozzles positioned between adjacent sets of axially disposed blades, wherein the set of nozzles includes at least one nozzle having: a base section coupled to the diaphragm section; a blade coupled to the base section; and a radial tip section coupled to a radial end of the blade, the radial tip section including an axially extending flange having a slot extending therethrough for controlling fluid flow within the turbomachine.

Various other aspects of the invention include a turbomachine having: a rotor section having sets of axially disposed blades; a diaphragm section at least partially surrounding the rotor section, the diaphragm section including a set of nozzles positioned between adjacent sets of axially disposed blades, wherein the set of nozzles includes at least one nozzle having: a base section coupled to the diaphragm section; a blade coupled to the base section; and a radial tip section coupled to a radial end of the blade, the radial tip section including: a radially facing surface; an axially facing surface adjacent the radially facing surface; and a slot extending through the axially facing surface and the radially facing surface for controlling fluid flow within the turbomachine.

Various further aspects of the invention include a turbomachine having: a rotor section having sets of axially disposed blades; a diaphragm section at least partially surrounding the rotor section, the diaphragm section including a set of nozzles positioned between adjacent sets of axially disposed blades, wherein the set of nozzles includes at least one nozzle having: a base section coupled to the diaphragm section; a blade coupled to the base section; and a radial tip section coupled to a radial end of the blade, the radial tip section including: an axially extending flange having a slot extending entirely radially therethrough for controlling fluid flow within the turbomachine; and a set of radially extending seal teeth connected with the radial tip section, wherein the slot extends radially between adjacent seal teeth in the set of radially extending seal teeth.

Various particular embodiments of the invention include a turbomachine having a rotor section having sets of axially disposed (rotatable) blades (buckets) and a diaphragm section at least partially surrounding the rotor section, the diaphragm section including a set of (stationary) blades (nozzles) positioned between adjacent sets of buckets. One set of buckets and nozzles defines a stage in the turbomachine. Inter-stage seals are placed between the nozzle's radial inner diameter and a radially outer surface of the rotor, and between bucket tip and diaphragm inner diameter. A swirl-inhibiting packing, defined by slots with a pre-determined angle on a stationary component coupled with at least a radial end of a rotating component, is placed upstream of at least one of the inter-stage seals.

Various other particular embodiments of the invention include a turbomachine having: a rotor section having sets of axially disposed (rotatable) blades (buckets); a diaphragm section at least partially surrounding the rotor section, the diaphragm section including a set of (stationary) blades (nozzles) positioned between adjacent sets of buckets, wherein the nozzles includes an inner cover; and a first seal is defined between the nozzle inner cover and rotor surface, the inner cover includes an axially extending flange having a slot extending therethrough for controlling angles of fluid flow into the first seal, and forming a second seal with a radial end of the bucket for driving fluid flow through the slot.

Further particular embodiments of the invention include a turbomachine having: a rotor section having sets of axially disposed (rotating) blades (buckets); a diaphragm section at least partially surrounding the rotor section, the diaphragm section including a set of (stationary) blades (nozzles) positioned between adjacent sets of buckets, wherein at least one of the nozzles includes an inner cover; a first seal defined between the nozzle inner cover and rotor surface, the inner cover further including: a radially facing surface; and an axially facing surface adjacent the radially facing surface; and a slot extending through the axially facing surface and the radially facing surface of the inner cover for controlling fluid flow into the first seal; and a second seal formed at a radial end of the rotating component for driving fluid flow through the slot.

Other particular embodiments of the invention include a turbomachine having: a rotor section having sets of axially disposed blades, each of the axially disposed blades including: a base section coupled to a body of the rotor; and a blade section extending radially from the base section; a diaphragm section at least partially surrounding the rotor section, the diaphragm section including a set of nozzles positioned between adjacent sets of the axially disposed blades, wherein the set of nozzles includes at least one nozzle having: a base section coupled to the diaphragm section; a blade coupled to the base section; and a radial tip section coupled to a radial end of the blade; a set of radially extending seal teeth extending from one of the body of the rotor or the radial tip section of the at least one nozzle; and a radial step extending radially from the diaphragm section, the radial step having a slot extending therethrough for controlling fluid flow within the turbomachine.

Even further particular embodiments of the invention include a turbomachine having: a rotor section having sets of axially disposed (rotatable) blades (called buckets); a diaphragm section at least partially surrounding the rotor section, the diaphragm section including a set of (stationary) blades (called nozzles), positioned between adjacent sets of buckets, wherein at least one bucket includes an outer cover; and a seal between the bucket outer cover and the diaphragm inner diameter, wherein the outer cover further includes at least one tooth engaging a radially extending step on the diaphragm. In various embodiments, the radially extending step on the diaphragm has a slot extending axially therethrough for controlling fluid flow entering the first seal.

As used herein, the terms "axial" and/or "axially" refer to the relative position/direction of objects along axis A, which is substantially parallel with the axis of rotation of the turbomachine (in particular, the rotor section). As further used herein, the terms "radial" and/or "radially" refer to the relative position/direction of objects along axis (r), which is substantially perpendicular with axis A and intersects axis A at only one location. Additionally, the terms "circumferential" and/or "circumferentially" refer to the relative position/direction of objects along a circumference which surrounds axis A but does not intersect the axis A at any location.

Turning to FIG. 1, a schematic cross-sectional view of a portion of a turbomachine (e.g., a steam turbine) 2 is shown according to various embodiments of the invention. As shown, the turbomachine 2 can include a rotor section 4 with a set of axially disposed rotor blades 6. As is known in the art, the rotor blades 6 (also referred to as buckets herein) can rotate with the rotor section 4 in response to fluid flow within the turbomachine 2. The rotor blades (buckets) 6 can include a base section 8 (also referred to as a dovetail section) coupled to the body 10 of the rotor section 4. The blades 6 can also include a blade section 7 extending radially from the base section 8 toward a diaphragm section 12 of the turbomachine. At a radial end of the blade 6 is a shroud 9. As noted, the turbomachine 2 can also include a diaphragm section 12 at least partially surrounding the rotor section 4. The diaphragm section 12 can include a set of nozzles 14 positioned between adjacent sets 16 of axially disposed rotor blades (buckets) 6. Each pairing of a set of nozzles 14 and set of blades (buckets) 16 is referred to as a "stage" of the turbomachine. As is known in the art, during operation of the turbomachine 2, working fluid (e.g., steam) enters a space between the diaphragm (shown as diaphragm section 12) and the rotor (shown as rotor section 4) (via an inlet, not shown), and is guided across the rotor blades (buckets) 6 (blade sections 7) by the nozzles 14 (in particular, the blade sections 22), which causes the rotor section 4 to rotate within the diaphragm section 12.

The sets of nozzles 14 in the diaphragm section 12 includes at least one nozzle 18 having a base section 20 coupled to the diaphragm section 12. The nozzle 18 further includes a blade (nozzle blade) 22 coupled to the base section 20. The nozzle 18 further includes a radial tip section (also referred to as an inner cover) 24, and a radial tip section 24 coupled to a radial end 26 of the blade 22. Along with radially extending seal teeth 33, which can extend from a surface 25 of the rotor body 10 or from the radially inner surface of the radial tip section 24, the radial tip section 24 and seal teeth 33 form a first seal (axial seal, also referred to as a "seal region") 32 between adjacent stages of the turbomachine 2.

The radial tip section 24 can include an axially extending flange 28 which includes a slot (or hole) 30 extending therethrough (e.g., at least partially radially therethrough). The axially extending flange 28 (including slot 30) is for controlling fluid flow, e.g., a direction of fluid flow (e.g., steam flow) within the turbomachine 2. That is, during operation of the turbomachine 2, the axially extending flange 28 (including slot 30) can help to inhibit swirl in fluid entering seal region 32 within the turbomachine 2. As described herein, "swirl" and/or "fluid swirl" can refer to tangential velocity component of fluid in the same direction of rotation.

FIG. 1 also shows that one of the axially disposed blades 6 adjacent to the at least one nozzle 18 includes a base section 8 with a hook flange 34 (e.g., a hook-shaped flange or other two-part flange which extends partially axially and partially radially, which can also be referred to as an "angel wing" flange). As shown, the hook flange 34 extends axially toward the at least one nozzle 18. The hook flange 34 can axially overlap with the axially extending flange 28 to form a (partial radial) second seal (also referred to as a second seal region) 35, that helps inhibit leakage flow from bypassing slot (or hole) 30 between a primary flow path 36 and a secondary flow path 38 within the turbomachine 2. Shown in the embodiment illustrated in FIG. 1, the hook flange 34 does not axially overlap with the slot 30 in the axially extending flange 28, so that the slot 30 still permits fluid flow therethrough to reduce fluid swirl entering seal 32 region within the turbomachine 2. FIG. 1 also shows that seal 32 includes a set of radially extending seal teeth 33, which can extend from the radially outer surface 25 of the rotor body 10 toward a radial end of the radial tip section (nozzle inner cover) 24 in some cases, or, in other cases, can extend from the radially inner surface of the radial tip section 24. In either case, the radially extending seal teeth 33 are coupled to one of the outer surface 25 of the rotor body 10 or the radially inner surface of the radial tip section 24.

The set of radially extending seal teeth 33 can form a tortuous path for leakage fluid (e.g., steam) to traverse, thus improving the efficiency of the turbomachine 2. In some cases, to further reduce leakage and improve turbomachine efficiency, one or more layers of abradable material 37 can be coated onto the radially inner diameter (surface) of the radial tip section (inner cover) 24 to reduce clearance between tips of the seal teeth 33 and the radially outer surface of the radial tip section (inner cover) 24, and to mitigate the risk of rotor rub. Further, the reduction in swirl caused by the slot 30 and the second seal region 35 can reduce the destabilizing unsteady steam force in the seal cavities within the first seal region 32 (between adjacent seal teeth 33), and therefore improve rotor-dynamic stability.

Figure 2:
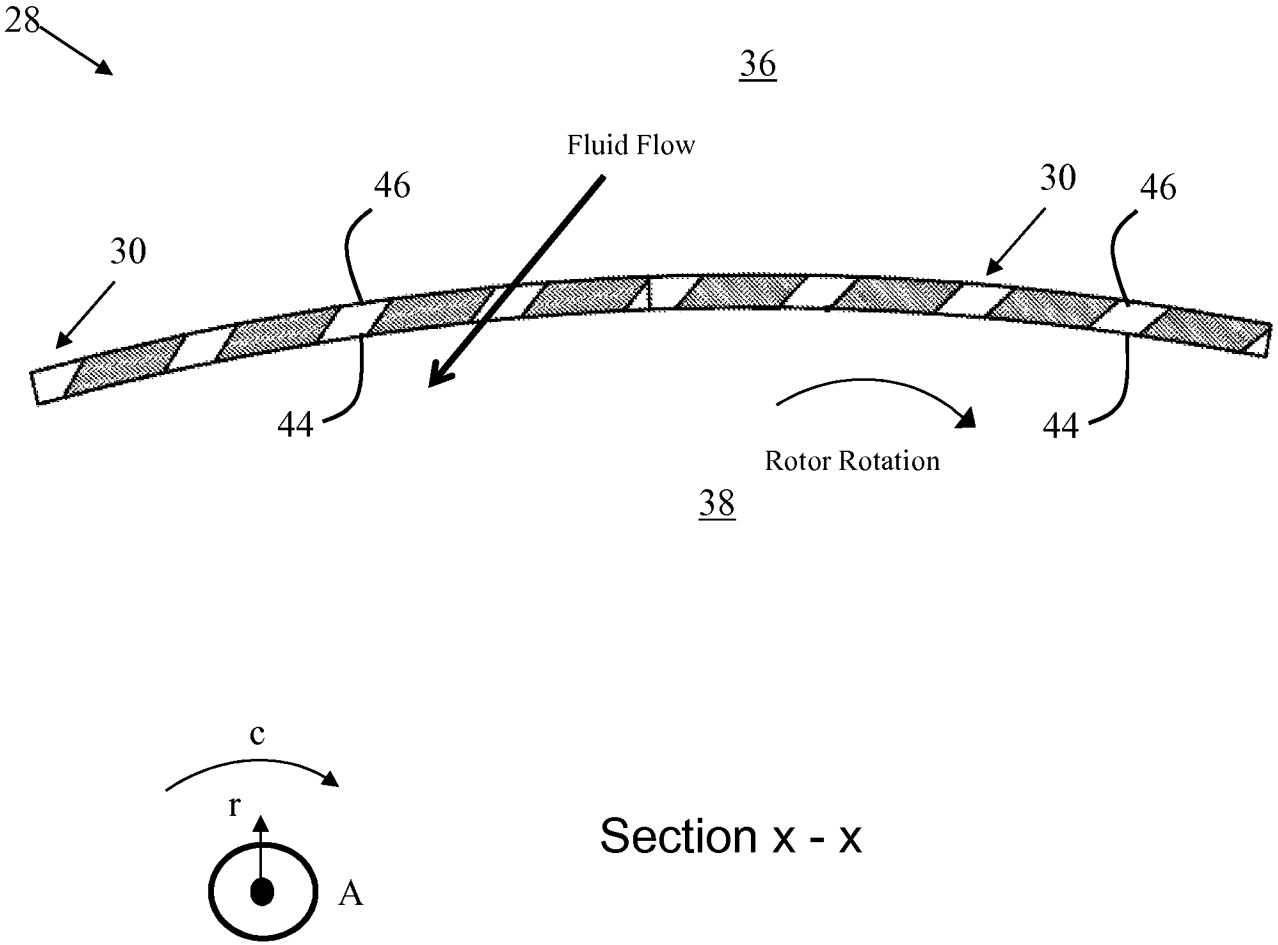
FIG. 2 shows a cut-away cross-sectional view of a section of the turbomachine of FIG. 1 according to various embodiments of the invention.

FIG. 2 shows a cut-away view of the axially extending flange 28, including a plurality of slots (or holes) 30 extending therethrough. In some cases, the slots 30 extend at least partially circumferentially through the axially extending flange 28. As shown, in all cases, the slots 30 extend entirely radially (r) through the axially extending flange 28. In some cases, the slots 30 have circumferentially offset openings, such that a radially inner opening 44 is circumferentially offset (not radially aligned with) a radially outer opening 46. As shown, the slot 30 is designed to permit fluid flow from the primary flow path 36 to the secondary flow path 38, which can help to inhibit fluid swirl within the secondary flow path 38 (or leaking path).

Figure 3:
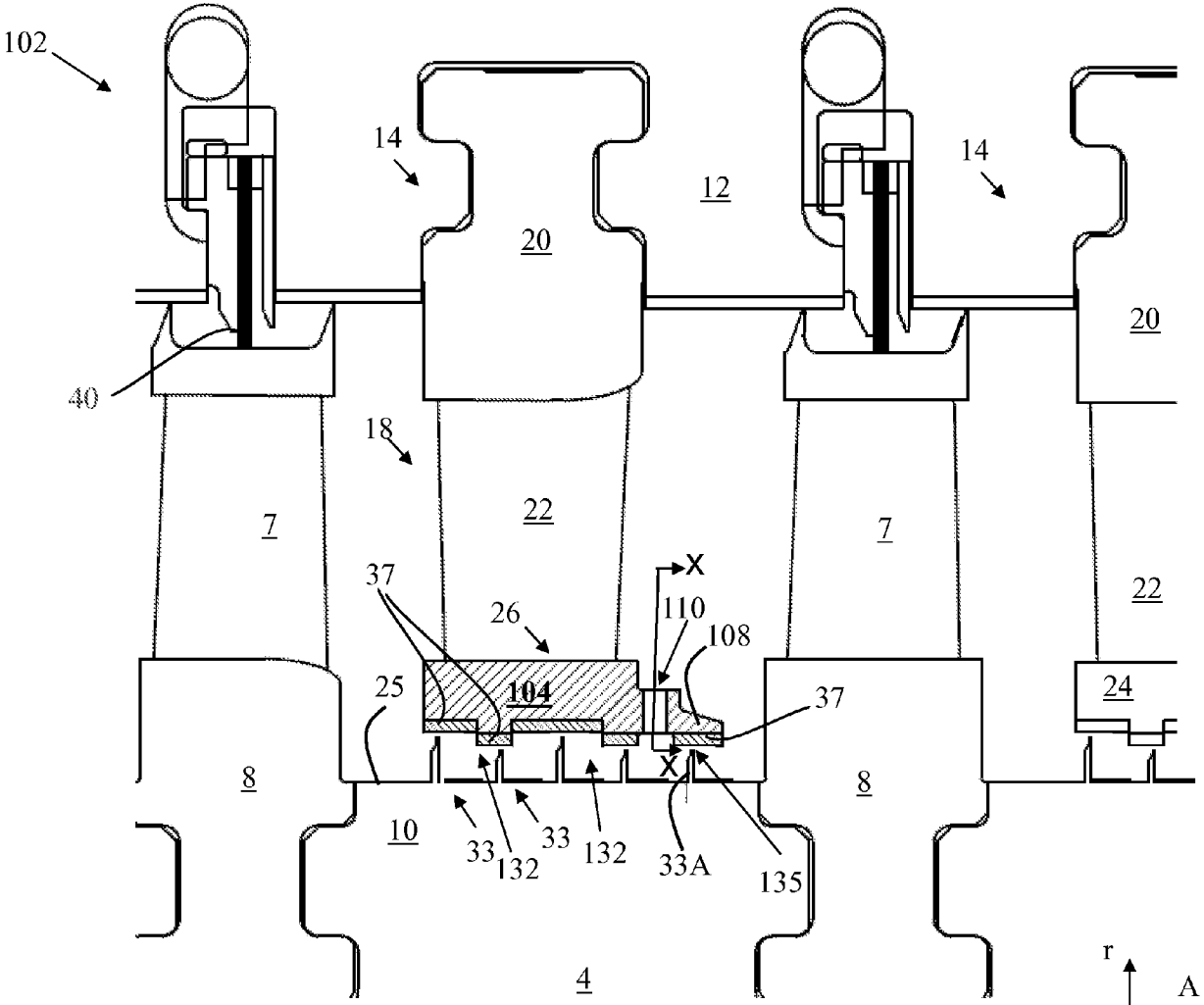
FIG. 3 shows a cross-sectional view of an alternative embodiment of a turbomachine according to various embodiments of the invention.

An alternate depiction of the turbomachine 2 of FIG. 1 is shown in the schematic cross-sectional depiction of turbomachine 102 in FIG. 3. In this case, identically numbered elements represent substantially identical components. In this depiction of the turbomachine 102 includes a radial tip section 104 coupled to the radial end 26 of the blade 22, where the radial tip section 104 includes an axial flange 108 having a slot 110 extending therethrough (e.g., entirely radially therethrough) for controlling a direction of fluid flow (e.g., steam flow. As described with reference to FIG. 1, the radial tip section 104 of turbomachine 102 can work along with seal teeth 33 to form a first seal section 132. The seal teeth 33 can extend radially from the surface 25 of the rotor body 10 and engage with the radially inner surface of the radial tip section 104. The first seal section 132 can aid in inhibiting axial secondary flow of fluid between stages of the turbomachine 102. In various embodiments, the axial flange 108, and in particular, the slot 110, can control a direction of the fluid flow that feeds to the first seal region 132 within the turbomachine 102. In various embodiments, the axial flange 108 has an inner sealing surface that mates with an axially outmost seal tooth 33A in the set of seal teeth 33, forming a second seal (or second seal region) 135. The sealing effectiveness of both seals 132 and 135 can be improved with an abradable coating 37 in some embodiments, which can be coated on the radial tip section 104. The slot 110 can be located between the first seal 132 and the second seal 135. In various embodiments, the slot 110 extends radially between adjacent seal teeth 33 in the set of seal teeth (e.g., between the axially outermost seal tooth 33A and its adjacent seal tooth 33. In some embodiments, the second seal 135 can force leakage fluid into the slot 110, and therefore control the direction of fluid flow leading to the first seal 132. Meanwhile, the first seal 132 can reduce leakage flow (e.g., of steam) that bypasses nozzle blades 22. In some cases, distinctly from the embodiment shown and described with reference to FIG. 1, the radial tip section 104 of turbomachine 102 includes a slot 110 that extends between adjacent seal teeth 33 extending from the surface 25 of the rotor body 10. In some cases, the slot 110 can have a similar cross-section as depicted with respect to slot 30 in FIG. 2.

Figure 4:
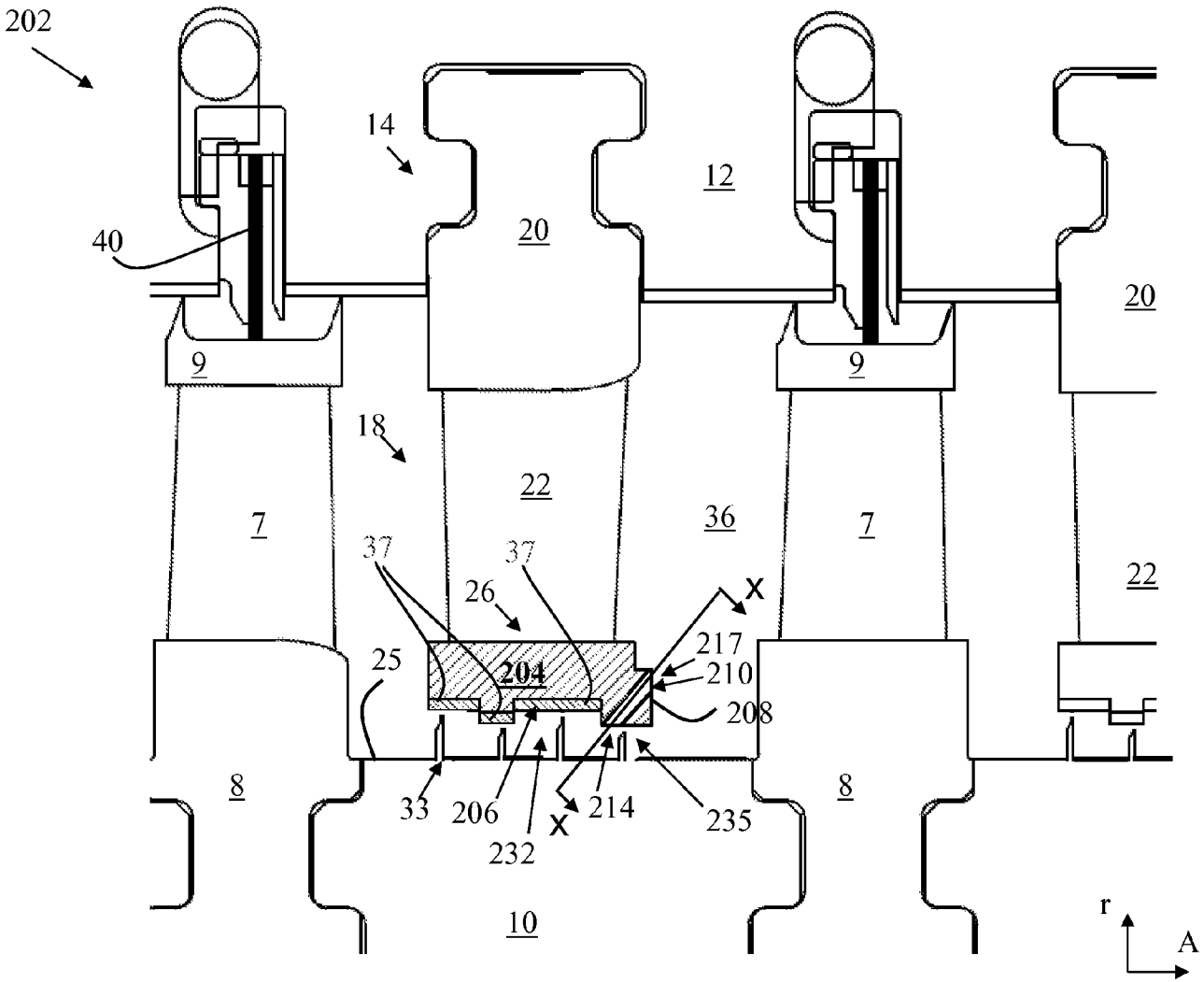
FIG. 4 shows a cross-sectional view of an alternative embodiment of a turbomachine according to various embodiments of the invention.

An alternate depiction of the turbomachine 2 of FIG. 1 and turbomachine 102 of FIG. 3 is shown in the schematic cross-sectional depiction of turbomachine 202 in FIG. 4. In this case, identically numbered elements represent substantially identical components. In this depiction, the turbomachine 202 includes a radial tip section (also called a nozzle inner cover) 204 coupled to the radial end 26 of the blade 22, where the radial tip section 204 includes a radially facing surface 206, an axially facing surface 208 adjacent to the radially facing surface 206, and a slot (or hole) 210 (at least one slot 210) extending through the axially facing surface 208 and the radially facing surface 206. The slot 210 can be used for controlling fluid flow within the turbomachine 202. In some cases, the slot 210 can be used for controlling a fluid flow direction that leads to a first seal 232, with the aid of a second seal 235.

In various embodiments, the slot 210 includes an opening 214 on the radially facing surface 206 between adjacent radially extending seal teeth 33 (extending from the radially outer wall 25 of the rotor body 10 toward the radially facing surface 206, mating with the radial tip section 204). As shown in FIG. 4, the radially facing surface 206 may consist of multiple stepped segments of faces. Some of the steps may be axially facing. In various embodiments, the slot 210 also includes an opening 217 on the axially facing surface 208 of the radial tip section 204 and another opening on the axially facing step. In some cases, the axially facing surface 208 is a downstream surface such as in case of a compressor. The slot can be used to mitigate swirl or to guide the leakage flow back to the main flow path. In various embodiments, the slot 210 extends substantially diagonally (in a straight line) between the radially facing surface 206 and the axially facing surface 208.

Figure 5:
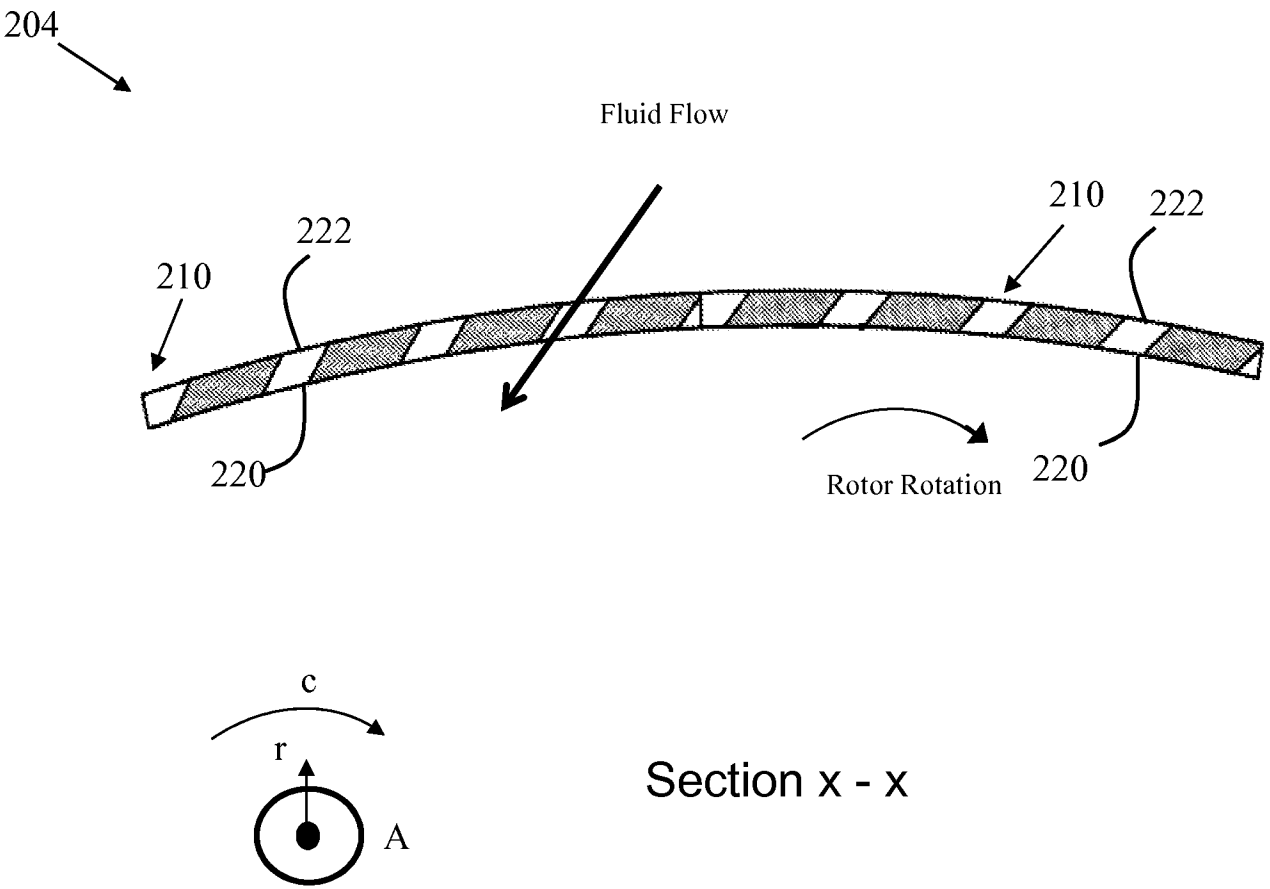
FIG. 5 shows a cut-away cross-sectional view of a section of the turbomachine of FIG. 4 according to various embodiments of the invention.

FIG. 5 shows a cut-away view of the radial tip section 204, through the slot 210, which shows a plurality of slots 210 extending through the radial tip section 204. In some cases, the slots 210 extend at least partially circumferentially through the radial tip section 204. As shown, in all cases, the slots 210 extend entirely radially (r) through the radial tip section 204. In some cases, the slots 210 have circumferentially offset openings, such that a radially inner opening 220 is circumferentially offset (not radially aligned with) a radially outer opening 222.

Figure 6:
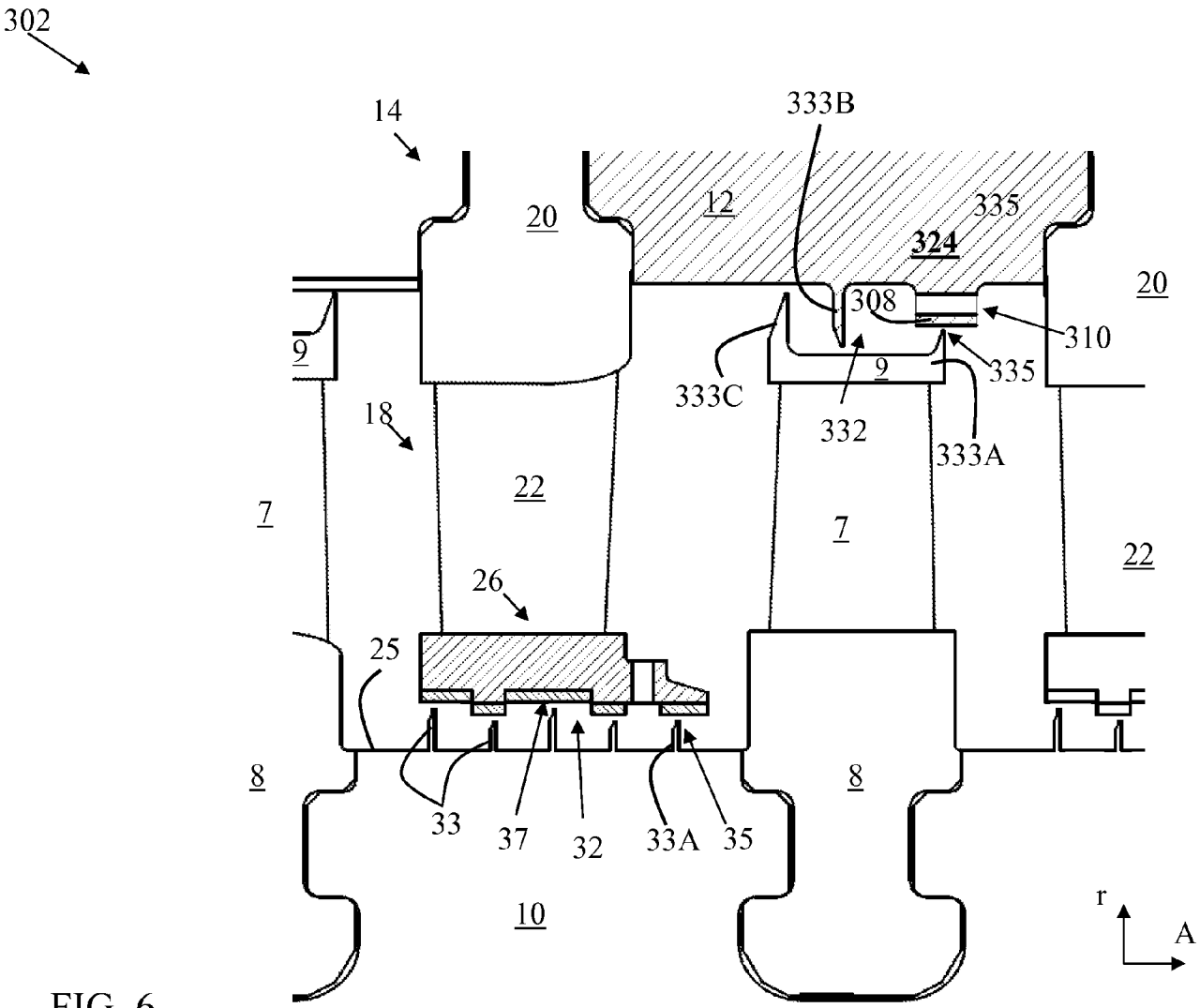
FIG. 6 shows a cross-sectional view of an alternative embodiment of a turbomachine with a swirl-inhibiting design according to various embodiments of the invention.

It is understood that the various embodiments of swirl-inhibiting nozzle seals described herein (e.g., with respect to FIG. 5) can be equally implemented in a bucket tip seal. In various alternative embodiments, as shown in FIG. 6, similar principles of flow interruption can be applied to the bucket tip location of a turbomachine 302. In these cases, a slot (or hole) 310 runs axially through a radial step feature 308 extending from a stationary component 324, which can be an integral or mounted part of diaphragm 12. A first seal region 332 is formed including seal teeth 333A, 333C (extending from the bucket shroud 9) and seal tooth 333B (extending from the radially inner facing surface of the diaphragm 12. These seal teeth 333A, 333C, 333B form a tortuous flowpath between bucket shroud 9 and diaphragm 12 to limit leakage. A second seal region 335 is also formed including at least one tooth 333A from bucket shroud 9 and an inner mating surface on the step feature 308. The second seal region 335 can force leakage flow through slot 310, thereby reducing positive swirl into the first seal 332.

Alternatively, seal tooth 333B could be replaced with a brush seal 40 as shown in FIGS. 1, 3 and 4. Additionally, a further abradable coating could be applied on the inner diameter (radially inner surface) of feature 308 (which contacts tooth 333A).

In various other embodiments, in order to further improve rotor-dynamic stability, slot 310 can angle circumferentially against the rotating direction of the turbomachine 302 to generate negative swirl that further stabilize rotordynamics.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. It is further understood that the terms "front" and "back" are not intended to be limiting and are intended to be interchangeable where appropriate.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A turbomachine comprising:

a rotor section having sets of axially disposed blades;

a diaphragm section at least partially surrounding the rotor section, the diaphragm section including a set of nozzles positioned between adjacent sets of axially disposed blades, wherein the set of nozzles includes at least one nozzle having:

a base section coupled to the diaphragm section;

a blade coupled to the base section; and a radial tip section coupled to a radial end of the blade, wherein the radial tip section and a first radially facing surface section of the rotor section create a seal region comprising a flowpath with a set of seal teeth therein, the radial tip section including an axially extending flange having a slot, wherein the axially extending flange and a second radially facing surface section directly face each other without obstruction to of the rotor section create a secondary flow path, the slot extending through the axially extending flange and opening into the secondary flow path, the secondary flow path being axially adjacent the seal region, wherein one of the axially disposed blades adjacent to the at least one nozzle further includes:

a base section coupled to the rotor body; and a blade section extending radially from the base section toward the diaphragm section, wherein the base section includes a hook flange extending axially toward the at least one nozzle, wherein the hook flange axially overlaps with the axially extending flange to form a partial radial seal outside the seal region.

2. The turbomachine of claim 1, wherein the a set of seal teeth extend radially from the rotor section and mate with the radial tip section.

3. The turbomachine of claim 1, wherein the set of seal teeth extend radially from the radial tip section and mate with the rotor section.

4. The turbomachine of claim 1, wherein the slot extends entirely radially through the axially extending flange.

5. The turbomachine of claim 1, wherein the hook flange does not axially overlap with the slot in the axially extending flange.

6. The turbomachine of claim 1, wherein the slot extends at least partially circumferentially through the axially extending flange.

* * * * *